United States Patent [19]

Dorrepaal et al.

[11] 4,157,296

[45] Jun. 5, 1979

[54] FLOTATION PROCESS FOR FLUORIDE MINERALS

[75] Inventors: Wim Dorrepaal; Gerardus M. Van den Haak, both of Bodegraven, Netherlands

[73] Assignee: Chem-Y Fabriek van Chemische Produkten B.V., Bodegraven, Netherlands

[21] Appl. No.: 815,025

[22] Filed: Jul. 11, 1977

[30] Foreign Application Priority Data

Jul. 16, 1976 [GB] United Kingdom ..... 29736/76

[51] Int. Cl.[2] ..... B03D 1/02

[52] U.S. Cl. ..... 209/167

[58] Field of Search ..... 209/166, 167

[56] References Cited

U.S. PATENT DOCUMENTS

| | | | |
|---|---|---|---|
| 2,407,651 | 9/1946 | Clemmer | 209/166 |
| 2,647,629 | 8/1953 | Veltman | 209/166 |
| 2,740,522 | 4/1956 | Aimone | 209/166 |
| 3,138,550 | 6/1964 | Woolery | 209/166 X |
| 3,259,569 | 7/1966 | Priesing | 260/54 R |
| 3,340,238 | 9/1967 | Smith | 209/5 |
| 3,617,572 | 11/1971 | Monagle | 210/54 A |
| 3,860,513 | 1/1975 | Hart | 209/1 |

FOREIGN PATENT DOCUMENTS

| | | | |
|---|---|---|---|
| 839181 | 5/1952 | Fed. Rep. of Germany | 209/166 |
| 1355091 | 12/1971 | United Kingdom | 209/166 |
| 316473 | 3/1968 | U.S.S.R. | 209/166 |

*Primary Examiner*—Robert Halper

*Attorney, Agent, or Firm*—Browdy and Neimark

[57] ABSTRACT

Flotation processes are provided, wherein a vinyl sulfonic acid polymer or an allyl sulfonic acid polymer is added to the pulp in a minor amount as a depressant for constituents which preferably should be floated to a minimum degree. Thus the polymers are effective barite-depressants in the flotation of fluoride minerals and rare earth carbonates. Also the polymers are useful as monazite depressants.

10 Claims, No Drawings

FLOTATION PROCESS FOR FLUORIDE MINERALS

The present invention relates to the flotation of ores, especially fluoride-containing ores and rare earth-containing ores and more specially to the use of certain polymers as depressants for undesirable constituents.

In various ores fluoride minerals occur in combination with barite ($BaSO_4$) and other gangue minerals, such as silicates, carbonates or quartz. It is desirable to recover from these ores a maximum yield of highly pure fluoride, and a.o. the recovered fluoride should be substantially barite-free. Flotation is a usual means of concentrating the fluoride. However, a difficulty in this respect is that flotation collectors which possess a high effectivity for fluoride, such as oleic acid in its various commercial forms (crude oleic acid, fish oil fatty acid, tall oil fatty acid an the like) or some of the ether-carboxylic acids disclosed in U.K. patent No. 1,355,091 which is incorporated herein by reference, are not sufficiently selective to recover a fluoride of the desired commercial grade. Special difficulties occur in situations where more than one fluoride is present in the ore, such as fluorite ($CaF_2$) and sellaite ($MgF_2$). In such cases it is desirable to recover as much as possible of both minerals, because they both can serve as source for HF and the like chemicals, but the simultaneously present barite then makes it difficult to obtain a sufficiently pure fluoride product at a high sellaite recovery. One has tried to solve this problem by a previous flotation of barite, but the disadvantage thereof is that an additional process step has to be used which adds to the cost of the final fluoride product. Also special problems arise, if the barite is present in the tailings of a previous flotation process and a further flotation step is necessary to separate barite from fluoride, because the barite which has already passed a flotation treatment has become more or less hydrophobic so that the separation between barite and fluorite even becomes more difficult.

Several barite-depressants are known in the art, such as polysaccharides (starches, dextrins), chromates and ligno sulfonates. However, chromium ions are environmental poisons, whereas polysaccharides and ligno sulfonates often are of a low effectivity/selectivity. Accordingly, with these materials high consumptions are frequently observed, leading to decreased fluorite recoveries. On the other hand, the character of the ore determines in some respect the type of depressant that can be used. In some ores there is no effect at all of polysaccharides, and ligno sulfonates; in other ores the chromates fail as barite depressants.

Accordingly, there is a need for effective barite-depressants which can be used in the flotation of fluoride minerals.

A principal object of the invention is to provide such a depressant which is highly effective and should be used in small amounts only.

An other object is to provide such a barite-depressant which is not poisonous to the environment.

A further object is to provide a barite-depressant which is not only useful in the flotation of fluoride-containing ores, but also in that of other ores, such as calcareous ores which contain rare earth carbonates as valuable constituent.

A still further object is to provide a barite-depressant which is also useful as depressant for monazite.

Further objects and advantages of the invention will appear from the following description.

Surprisingly, it has been found that polymers of vinyl sulfonic acid and allyl sulfonic acid possess a very effective action as barite-depressants in the flotation of fluoride minerals and rare earth carbonates, and also as monazite-depressants in the flotation of fluoride minerals. This is the more surprising, since such polymers have never been used for a related purpose.

The present polymers are highly effective/selective as $BaSO_4$-depressants and have the advantage of a very low toxicity.

The polymers may be used both in the acid and in the salt form, the actual form depending on the pH of the flotation pulp.

Polymers of vinylsulfonic acid and allyl sulfonic acid can be very easily formed in aqueous solutions under the influence of ultraviolet light or free-radical initiators, vide for example J. Am. Chem. Soc. 76, 6399 (1954) and J. Polymer Science 27, 295 (1958), and as is also known, crystalline sodium vinyl sulfonate on standing at room temperature polymerises spontaneously, vide J. Am. Chem. Soc. 76, 5361 (1954). However, the exact way of preparing the polymer is not critical to the invention.

Copolymers (including block copolymers and graft copolymers) of the vinyl and/or allyl sulfonic acid can also be used, provided the comonomers are not hydrophobic and do not contain functional groups which would interfere with the desired flotation.

Combinations of the present sulfonic acid polymers and polysaccharides, such as dextrin, can also be used. It should be remarked that the exact chemical nature of such combinations is not always known; they might be physical mixtures, but also graft copolymers.

The vinyl and allyl sulfonic acid polymers have to be used in a minor amount only. Useful results are generally obtained with about 20 to 250 grams of either vinyl sulfonic acid polymer or allyl sulfonic acid polymer per ton of original ore. It should be remarked in this respect that the amounts of flotation additives are usually indicated on the basis of the original ore, irrespective whether a substance is added in the rougher or in a cleaner.

The good results obtained with the present polymers are the more surprising, because related products do not give such good results. Thus, the following comparative materials can be mentioned in this respect:

1. An adduct of polyacrolein and bisulfite. Such an adduct has a barite-depressant activity, but much less effective, and moreover, it has also a depressant activity on calcium salts so that it decreases the overall selectivity of the flotation.
2. Sulfomethylated polyacrylamide (i.e. the amide groups have been converted to —NH—$CH_2$—$SO_3H$ groups). This product also has a depressant activity on barite, but much less than the vinyl and allyl sulfonic acid polymers.

The following examples are intended to elucidate this invention without, however, limiting it in any respect.

EXAMPLE 1

This example shows the selective flotation of sellaite from a synthetic mineral mixture, consisting of 20% $MgF_2$, 20% $BaSO_4$ and 60% $SiO_2$ (quartz). Such a selective flotation presents very difficult problems, because it appears very difficult to float $MgF_2$ with the usual oleic acid. On the other hand a so-called "bulk-flotation" of $BaSO_4$ plus $MgF_2$ is possible with a collector of the type as disclosed in the above mentioned U.K. patent No. 1,355,091. A suitable collector in this respect is a product of the formula $C_{14}H_{29}O\ (C_2H_4O)_2—CH_2COONa$. In the following experiments the mineral mixture had been previously crushed so that 80% of the mixture had a particle size of less than 150 microns. A batch cell of 0.2 liter was used.

In a first experiment 50 grams of the crushed mineral mixture was introduced in the batch cell and conditioned with 150 ml water and 10 mg of the above mentioned collector (corresponding to 200 grams per ton of ore) for one minute. After air had been passed through the mixture a "bulk concentrate" was obtained containing 40% $MgF_2$, 48% $BaSO_4$ and 12% $SiO_2$, the tailing containing 8% $MgF_2$, 3% $BaSO_4$ and 89% $SiO_2$.

In a second experiment the flotation was carried out in the same way, but with additionally 10 mg (200 grams per ton of ore) polyvinyl sulfonic acid. Now a much more suitable separation was obtained, as follows:

concentrate: 70% $MgF_2$, 10% $BaSO_4$, 20% $SiO_2$.

tailing: 7.5% $MgF_2$, 22.5% $BaSO_4$, 70% $SiO_2$.

By reflotation (cleaning) of the so obtained concentrate the sellaite can be further purified. In this case the depression of $BaSO_4$ by conventional depressants, like dextrins, starches, chromates or ligno sulfonates, failed completely.

EXAMPLE 2

An ore was used containing about 30% $CaF_2$, about 15% $BaSO_4$ and about 55% of silicates. This ore was prepared for flotation in the usual way by crushing.

In a first experiment a flotation was carried out with 500 grams/ton of flotation grade oleic acid and 500 grams/ton of dextrin, a known barite depressant, and the obtained concentrate was subjected to five additional flotations (cleanings). Ultimately a concentrate was so obtained containing 90% $CaF_2$, 9% $BaSO_4$ and 1% and 1% $SiO_2$.

In a second experiment the same flotation was carried out, but replacing the dextrin by one tenth of the amount (50 grams per ton) of polyvinyl sulfonic acid. Again five cleaning treatments were carried out after the first flotation. A final concentrate was obtained containing 98% $CaF_2$, 1% $BaSO_4$ and 1% $SiO_2$, and the total amount of recovered fluorite was the same as in the previous experiment. This means that with this small amount of the new depressant a final concentrate of fluorite is obtained which is of so-called "acid grade."

In a third experiment the same flotation was carried out with polyallyl sulfonic acid (50 grams/ton). After the fifth cleaning treatment a final concentrate was obtained containing 97.5% $CaF_2$, 1.5% $BaSO_4$ and 1% $SiO_2$ at substantially the same fluorite recovery.

EXAMPLE 3

A natural ore was used containing 55% $BaSO_4$, 20% $CaF_2$ and 25% silicates. First the $BaSO_4$ and selectively floated with the aid of a selective commercial $BaSO_4$ collector, a mixture of $C_{16}$–$C_{20}$ alkyl sulfates. The tailing contained 10% $BaSO_4$, 40% $CaF_2$ and 50% silicates. It should be remarked here that the $BaSO_4$ in these tailings had been contacted already with collector so that the separation from the $CaF_2$ had become more difficult.

A flotation with oleic acid in an amount of 400 grams per ton of original ore was carried out with this tailing, followed by three cleaning treatments. The final concentrate contained 21% $BaSO_4$, 68% $CaF_2$ and 1% $SiO_2$.

In another experiment 100 grams per ton of original ore of polyvinyl sulfonic acid was added to the oleic acid flotation. After the three cleaning treatments the same recovery of $CaF_2$ was obtained, but this time in acid grade (97.5% pure).

As mentioned already, it has also appeared that the present sulfonic acid polymers can be used as depressants for other minerals which are present in combination with fluoride. This is elucidated in the following example:

EXAMPLE 4

A fluorite ore containing 25% $CaF_2$ and 1% of monazite was subjected to a flotation at pH 10 (NaOH) with 250 grams per ton of oleic acid (flotation grade). Almost all the monazite was found in the fluorite concentrate (4% monazite and 94% $CaF_2$).

In a second experiment the flotation was carried out with the addition of 25 grams per ton of polyvinyl sulfonic acid. This time a concentrate was obtained containing less than 0.5% of monazite at a comparable fluorite recovery.

EXAMPLE 5

A calcareous ore containing various rare earth carbonates (10%), calcite (40%) together with barite (12%) and various siliceous gangue minerals was floated with conventional reagents (Quebracho (300 g/t) as a calcite depressant, ligno sulfonate (2000 g/t) as a barite depressant, water glass (500 g/t) as a silicate depressant and flotation grade oleic acid (300 g/t) as collector). The concentrate, grading 69% rare earth carbonates, still contained 4% $BaSO_4$ at 75% recovery.

An analogous experiment was carried out with 100 g/t polyvinyl sulfonic acid (sodium salt) instead of the ligno sulfonate and the same amounts of the other reagents. This time a concentrate was obtained grading 72% rare earth carbonates and containing less than 1% $BaSO_4$ at a recovery of 83%.

Evidently, various modifications can be made in the light of the discussion and disclosure hereinabove without departing from the scope thereof.

What is claimed is:

1. A process for the flotation of fluoride minerals, from an ore which also contains barite, using a collector which possesses a high effectivity for fluoride and while depressing the barite, comprising adding to the flotation pulp a minor amount sufficient to depress barite of a substance selected from the group consisting of anionic vinyl sulfonic acid polymers and anionic allyl sulfonic acid polymers, which are not hydrophobic and which do not contain functional groups which interfere with the desired flotation.

2. The process of claim 1, wherein the ore contains fluorite and sellaite as minerals to be floated.

3. The process of claim 2, wherein a collector of the ether-carboxylic acid type is used.

4. The process of claim 1, wherein a collector of the fatty acid type is used.

5. The process of claim 1, wherein said polymer is used in an amount of 20 to 250 grams per ton of the original ore.

6. A process in accordance with claim 1, wherein said vinyl sulfonic acid polymers and allyl sulfonic acid polymers are selected from the group consisting of vinyl sulfonic acid homopolymers, allyl sulfonic acid homopolymers, copolymers of vinyl sulfonic acid with allyl sulfonic acid, hydrophilic copolymers of vinyl sulfonic acid with minor amounts of other comonomers which do not provide the resultant copolymer with functional groups which would interfere with the desired flotation, and hydrophilic allyl sulfonic acid copolymers with comonomers which do not provide the resultant copolymer with functional groups which would interfere with the desired flotation.

7. A process in accordance with claim 1, wherein said polymer is used in combination with dextrin.

8. A process for the flotation of fluoride minerals, from an ore which also contains monazite, using a collector which possesses a high effectivity for fluoride and while depressing the monazite, comprising adding to the flotation pulp a minor amount sufficient to depress monazite of a substance selected from the group consisting of anionic vinyl sulfonic acid polymers and anionic allyl sulfonic acid polymers, which are not hydrophobic and which do not contain functional groups which interfere with the desired flotation.

9. A process for the flotation of rare earth carbonates, from an ore which also contains barite, using a collector which possesses a high effectivity for rare earth carbonates and while depressing the barite, comprising adding to the flotation pulp a minor amount sufficient to depress barite of a substance selected from the group consisting of anionic vinyl sulfonic acid polymers and anionic allyl sulfonic acid polymers, which are not hydrophobic and which do not contain functional groups which interfere with the desired flotation.

10. A process in accordance with claim 9, wherein said polymer is used in an amount of 20 to 250 grams/ton of the original ore.

* * * * *